US010220251B2

(12) United States Patent
Cullison

(10) Patent No.: US 10,220,251 B2
(45) Date of Patent: Mar. 5, 2019

(54) PORTABLE BACK TRACTION DEVICE AND METHOD OF USE

(71) Applicant: Robert Floyd Cullison, Caledonia, MI (US)

(72) Inventor: Robert Floyd Cullison, Caledonia, MI (US)

(73) Assignee: Robert F. Cullison, Caledonia, MI (US)

( * ) Notice: Subject to any disclaimer, the term of this patent is extended or adjusted under 35 U.S.C. 154(b) by 0 days.

(21) Appl. No.: 15/902,852

(22) Filed: Feb. 22, 2018

(65) Prior Publication Data

US 2018/0221709 A1 Aug. 9, 2018

(51) Int. Cl.
*A63B 21/00* (2006.01)
*A63B 23/00* (2006.01)
*A63B 23/02* (2006.01)

(52) U.S. Cl.
CPC .... *A63B 23/0238* (2013.01); *A63B 21/00185* (2013.01); *A63B 21/4035* (2015.10); *A63B 2023/006* (2013.01); *A63B 2210/50* (2013.01)

(58) Field of Classification Search
CPC ..... A63B 23/0238; A63B 21/4035; A63B 21/00185; A63B 2023/006; A63B 2210/50
See application file for complete search history.

(56) References Cited

U.S. PATENT DOCUMENTS 3,904,195 A 9/1975 Chavanne
4,102,336 A * 7/1978 Wiener ..... A61H 1/0218 606/241
5,070,865 A 12/1991 Iams
5,217,487 A 6/1993 Engel et al.
5,232,425 A * 8/1993 Miller ..... A63B 21/0004 482/121
5,336,139 A 8/1994 Miller
5,437,609 A 8/1995 Leonard et al.
5,462,518 A 10/1995 Hatley et al.
(Continued)

FOREIGN PATENT DOCUMENTS

CN 2172623 7/1994

OTHER PUBLICATIONS

Stankovic R, et al Conservative treatment of acute low-back pain. A prospective randomized trial: McKenzie method of treatment versus patient education in "mini back school". (Journal) Feb. 15, 1990 [Spine (Phila Pa 1976). 1991], U.S.A.
(Continued)

*Primary Examiner* — Andrew S Lo

(57) ABSTRACT

A device that is used to extend the spine and put it in traction, that is portable and user friendly. The device in an embodiment is grasped by the handles on either side and then is pushed toward the lower leg and against the upper calves via vertical intermediary bar pushing the legs with a horizontal bar in one direction and the shoulders in the other. The described process stretching the spine and putting the back in traction for the purposes of pain relief and stretching of the back muscles. The device can be an inexpensive alternative to other devices, as well as, easier to use. The force placed on the device and therefore on the spine or back is controlled by the user as is the ability to stop quite quickly if pain were to arise, giving the user complete and instant control.

13 Claims, 2 Drawing Sheets

(56) References Cited

U.S. PATENT DOCUMENTS 5,542,898 A * 8/1996 Wilkinson ..... A63B 21/0552 482/120
5,820,520 A * 10/1998 Sieber ..... A63B 23/0227 482/34
5,842,960 A * 12/1998 Yu ..... A63B 23/0488 482/131
5,941,806 A * 8/1999 Olschansky ..... A63B 23/0222 482/132
5,989,168 A * 11/1999 See ..... A61H 1/0292 482/142
6,056,675 A 5/2000 Aruin et al.
6,135,931 A * 10/2000 Padula, Od, II ..... A61H 3/00 482/148
6,193,638 B1 * 2/2001 Barrett ..... A63B 21/0004 482/121
6,203,473 B1 * 3/2001 Atwood ..... A63B 21/00047 482/142
6,428,496 B1 * 8/2002 Sargent ..... A61F 5/04 602/32
6,846,270 B1 1/2005 Etnyre
7,090,303 B2 8/2006 Kropa
7,320,668 B1 1/2008 Warder
7,946,971 B2 * 5/2011 Conley ..... A61H 1/0244 482/131
7,998,043 B2 8/2011 Zhou et al.
8,287,439 B2 * 10/2012 Evans ..... A63B 23/0233 482/132
8,764,617 B2 * 7/2014 Teeter ..... A61H 1/0292 482/126
8,905,952 B2 * 12/2014 Berthiaume ..... A61H 1/0218 601/134
9,358,424 B1 * 6/2016 Childress ..... A63B 23/0233
9,687,406 B1 * 6/2017 Steiner ..... A61H 1/0218
2005/0181917 A1 * 8/2005 Dayal ..... A61H 1/0222 482/142
2006/0116262 A1 6/2006 Pandozy
2007/0270727 A1 11/2007 Khorassani Zadeh
2008/0182730 A1 * 7/2008 Conley ..... A61H 1/0244 482/95
2010/0279832 A1 * 11/2010 Conley ..... A61H 1/0244 482/131
2013/0029812 A1 * 1/2013 Teeter ..... A61H 1/0292 482/126
2015/0065319 A1 * 3/2015 Wald ..... A61F 5/042 482/132
2015/0313784 A1 * 11/2015 Evans ..... A61H 1/0229 602/36
2015/0360071 A1 * 12/2015 Lee ..... A63B 21/026 482/116
2016/0081872 A1 * 3/2016 Samson ..... A61H 1/0292 602/36
2018/0085614 A1 * 3/2018 Leier ..... A63B 21/0023

OTHER PUBLICATIONS

Kaesler D.S., A novel balance exercise program for postural stability in older adults: A pilot study. (Journal) Jan. 2007, Journal of Bodywork and Movement Therapies. U.S.A.

Gagnon D, et al Trunk and upper extremity kinematics during sitting pivot transfers performed by individuals with spinal cord injury. (Journal) Mar. 23, 2008, Clin Biomech (Bristol, Avon).

Demont, RG, et al Comparison of two abdominal training devices with an abdominal crunch using strength and EMG measurements. (Magazine) Sep. 1999, U.S.A.

Esquenazi A, et al The ReWalk powered exoskeleton to restore ambulatory function to individuals with thoracic-level motor-complete spinal cord injury. (Journal) Nov. 2012 Am J Phys Med Rehabilitation, U.S.A.

Messier S, et al Dynamic analysis of trunk flexion after stroke. (Journal) Oct. 2004 Arch Phys Med Rehabilitation, U.S.A.

Crosby CA, et al Conservative treatment for thoracic outlet syndrome. 2004.

Leivadi, PhD, Stella, et al Massage Therapy and Relaxation Effects on University Dance Students. (Journal) 1999, vol. 3, No. 3 Journal of Dance Medicine & Science, U.S.A.

Garces, Gerardo L., et al Normative database of isometric cervical strength in a healthy population. (Journal) Submitted for publication Feb. 2000; Accepted for publication Jun. 2001 Office Journal of the American College of Sports Medicine, pp. 464-470. U.S.A.

Norris, Christopher M Theory and Practice, Spinal Stabilisation: 5. An Exercise Programme to Enhance Lumbar Stabilisation, 1995.

* cited by examiner

PORTABLE BACK TRACTION DEVICE AND METHOD OF USE

This is a non-provisional patent application under 35 USC section 111(a).

BACKGROUND

The present invention relates to a simple device consisting of bars fashioned so that there is a horizontal bar that is padded and at least one vertical bar with grip handles mounted on the opposite end of the vertical bar in a fashion that a person can grab them easily. The horizontal bar is then placed behind the upper calves area of the user in laying down in a flat position, with the torso and the thigh area of the legs in line, with their legs bent at the knee. The person would then grip the grip handles and push on the backs of the calves, thus pushing the legs in one direction and the shoulders in the other direction lengthening the spine and putting it in traction to relieve back pain and stretch back muscles. This device was conceived out of necessity to alleviate the inventors own back pain. To my knowledge, this is the simplest and least expensive unique unit that is designed for back traction at the present time.

This device is superior to other methods such as units that push on the fronts of the thighs for several reasons. First, pushing on the calf muscle is not nearly so sensitive to pain as the fronts of the thighs. Secondly, very heavy set people cannot use the thigh pushing method to good effect, because of the physical position of the abdomen being large pushing the device toward the knee and thus becoming ineffective for use, this is not an issue with the present device pushing on the calves. Thirdly, the thigh pushing method is less effective given the position of the legs, the leg is bent at the knee and the lower part of the leg to the foot is at such a position and angle as to resist the device's applied pressure, lowering its effectiveness. This is not an issue with the present device pushing on the upper calves.

SUMMARY OF THE PRESENT INVENTION

The main aspect of the device is to stretch the back and put it in traction, thus relieving pain from back compression and other issues by pushing on the backs of the calves with a very simple and inexpensive device. The invention consists of a horizontal bar with a soft covering or enlarged area to cushion or spread out forces from the device to the calf area of the leg. The device also has a vertical bar or bars that attach to the first horizontal bar on one end, which may or may not be extendable, to which horizontal handles or other handles for grabbing and pushing on the opposite end.

The method of pushing on the backs of the calves in a laying position, either on one's back or stomach, with the legs bent at a 90 degree angle. The device is pushed by the handles through the vertical bar or bars to the lower horizontal bar creating force pushing the lower part of the body in one direction and the shoulders in the other direction, thus putting the back and spine in traction, extending the gaps between vertebrae relieving pressure and pain as well as stretching the muscles in the back.

The method of use also does not rely on the persons weight to operate.

A BRIEF DESCRIPTION OF THE DRAWINGS

DETAILED DESCRIPTION OF PREFERRED EMBODIMENTS

The present invention is a very simple device meant to put one's back in traction or in an extended state for the purpose of pain relief and stretching of the back muscles. This is done by a person lying on their back (FIG. 1) or on their stomach (FIG. 2) with their legs bent at the knees, the device is pushed with the handle portion ("2") through the vertical portion ("1") which is attached to the horizontal bar ("3") pushing on the back of the person's upper calves. This then pushes the legs of the person in one direction and the shoulders in the other direction stretching the person's back and opening the gaps between the vertebrae and stretching muscles relieving pain. The bars and handles can have many cross sections, such as but not limited to, tubular, solid round, square, etc., as long as it is strong enough to keep its embodied shape during use. The handles ("2") may or may not have a comfortable grip applied as indicated or come with a ball or grip that extends from the end of vertical bar ("1") opposite of horizontal bar ("3") to push the device toward the calves in the method described.

Figure 3:
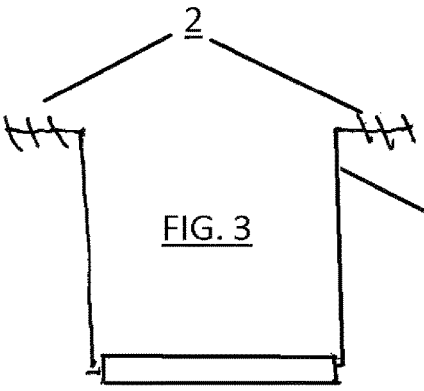
FIG. 3 is a view of the preferred embodiment of the device.
Figure 4:
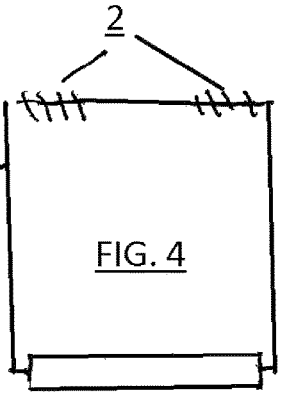
FIG. 4 is a view of an alternate device embodiment that can be used with this method.
Figure 5:
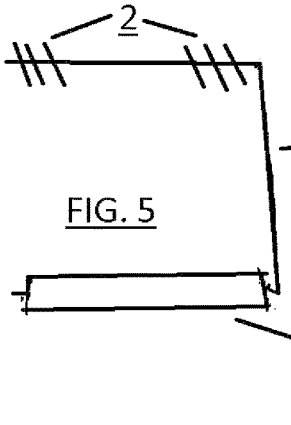
FIG. 5 is a view of an alternate device embodiment that can be used with this method.
Figure 6:
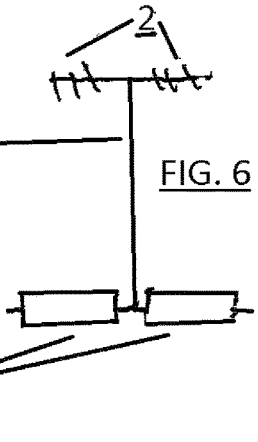
FIG. 6 is a view of an alternate device embodiment that can be used with this method.

The present invention as described is simple as it can be made by bending a single bar or tube in four places as is pictured in the preferred embodiment (FIG. 3). The vertical bars/bar ("1") can be made extendable for different sizes of people for very little expense. In either case the device is the simplest and thus the least expensive to produce device for producing back traction yet devised making it more accessible to the public and therefore more likely to be purchased and used than any other device.

The present invention is meant to be easier to use than other devices for people of all sizes and shapes. Heavy people have trouble using devices that push on the fronts of the legs or thighs, people of a large size would find it difficult to use such a device due to the device being pushed up the leg to the knee by a large abdomen and as such not extending the spine. The fronts of the thighs are also much more sensitive than the backs of the calves, other devices also pull on one's neck and push on the sensitive tops of their feet. The present invention does not rely on a person's weight to operate as does inversion type devices. These reasons make the preferred embodiment (FIG. 3) more effective and less painful than other devices making the present invention's method of use superior.

The person using the present invention or device is in full control of the pressure placed to extend and put their back in traction. The person as seen in (FIG. 1 & FIG. 2) can release pressure at a moment's notice if pain was to occur. This makes the present invention and it's method of use superior to other devices.

Figure 1:
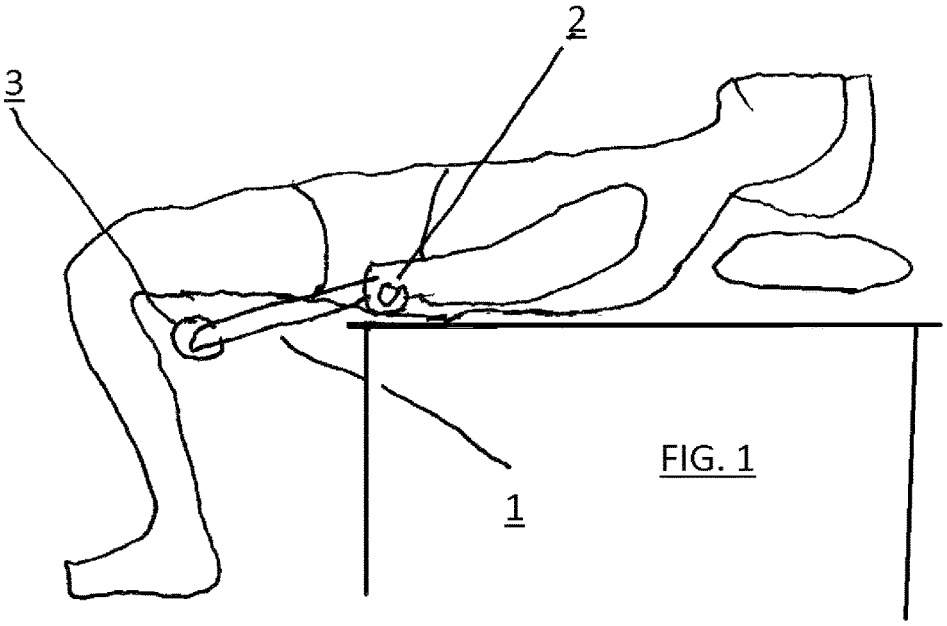
FIG. 1 is a side view of the device being used with the user lying on his/her back.
Figure 2:
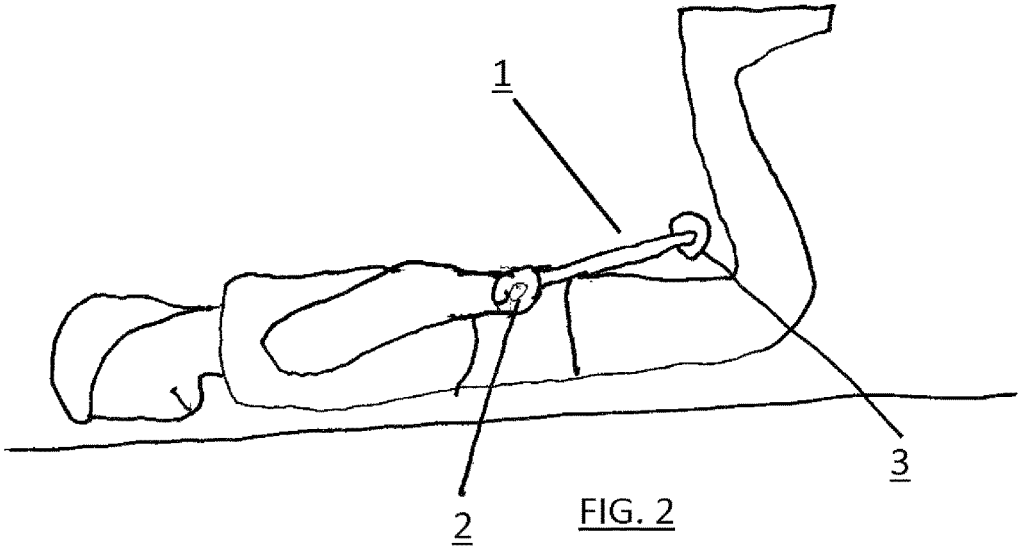
FIG. 2 is a side view of the device being used with the user lying on his/her stomach.

The present invention's method of use entails that the person using it be in a lying position with the thigh portion of the leg is flat and in line to the torso (FIG. 1 & FIG. 2). This means that when extending the length of the spine to put it in traction that the vertebrae will be in the same position as when standing, thus extending the spine in a more natural position than other devices, and not hyper extending gaps between the vertebrae as with other positions such as sitting.

The present invention's bottom horizontal bar ("3") would be best if covered with a foam or cushioning material or be of a large enough size or shape as to spread out pressure exerted by the device to the calves of the legs during use.

The present invention's shape or embodiment can be of many shapes such as but not limited to those on (Page 2) with the preferred embodiment being (FIG. 3), and still maintain the method of use described.

The invention claimed is:

1. A method of using a portable back traction device comprising the steps of:

providing a portable back traction device having a handle coupled to a horizontal bar via at least one vertical bar, wherein the handle is spaced a distance away from the horizontal bar via a length of the at least one vertical bar;

positioning a user in a lying position on a surface such that the user's thighs are aligned linearly with the user's torso in a line on the surface and bending the user's knees at a 90 degree angle;

placing the horizontal bar at a back of the user's knees such that the horizontal bar contacts a back of the user's upper calves; and pushing the handle with the user's arms such that the horizontal bar pushes against the back of the user's upper calves in one direction and pushes the user's shoulders in an opposite direction thereby stretching the user's back.

2. The method of claim 1, wherein the user in the lying position is positioned either face up or face down on the surface.

3. The method of claim 1, wherein the user applies pressure to the upper calves sufficient to place the user's back in traction and opening gaps between vertebrae of the user and stretching back muscles of the user.

4. The method of claim 1, wherein the stretching of the user's back is sufficient to cause the lower back to be put in traction relieving pain and for stretching of back muscles.

5. The method of claim 1, wherein the handles are provided as a comfortable grip extending from the vertical bar opposite the horizontal bar.

6. The method of claim 1, wherein the vertical bar is extendable to allow for use by different sized users.

7. The method of claim 1, wherein the vertical bar, horizontal bar and handle are formed from a single bar bent in four places to form a horizontal portion and a pair of spaced apart vertical portions extending an equal distance away from the horizontal bar and forming handles opposite the horizontal bar.

8. The method of claim 1, wherein the portable back traction device includes:

a single frame forming the horizontal bar and the vertical bar extending directly from and away from the horizontal bar at an angle perpendicular to the horizontal bar;

wherein the handle includes a pair of parallel handle portions extending perpendicular from the vertical bar and spaced apart at an opposite end from the horizontal bar;

wherein the horizontal bar includes a soft area to allow for comfort and force distribution across the horizontal bar.

9. The method of claim 8, wherein the single frame forms a pair of spaced apart vertical portions extending directly from and away from the horizontal bar in the same direction and the pair of parallel handle portions extend from each vertical portion respectively.

10. The method of claim 9, wherein the horizontal bar includes opposed ends and the vertical portions extend away from the ends of the horizontal bar perpendicular to the horizontal bar.

11. The method of claim 1, wherein the horizontal bar is padded.

12. The method of claim 1, wherein the portable back traction device can be disassembled for travel and portability.

13. The method of claim 1, wherein the vertical bar is extendable.

* * * * *